US010647125B1

(12) United States Patent
Sohgawa et al.

(10) Patent No.: US 10,647,125 B1
(45) Date of Patent: May 12, 2020

(54) FLUID TANK WITH FLEXIBLE MEMBRANE FOR A FLOW-THROUGH PRINTHEAD

(71) Applicants: Norimasa Sohgawa, Kanagawa (JP); Hiroshi Nishimura, West Hills, CA (US)

(72) Inventors: Norimasa Sohgawa, Kanagawa (JP); Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/351,182

(22) Filed: Mar. 12, 2019

(51) Int. Cl.
*B41J 2/175* (2006.01)
*B41J 2/14* (2006.01)

(52) U.S. Cl.
CPC ..... *B41J 2/17513* (2013.01); *B41J 2/14233* (2013.01); *B41J 2/17503* (2013.01); *B41J 2/17523* (2013.01); *B41J 2/17556* (2013.01); *B41J 2/17559* (2013.01); *B41J 2/14274* (2013.01); *B41J 2/17596* (2013.01)

(58) Field of Classification Search
CPC .... B41J 2/175; B41J 2/17503; B41J 2/17513; B41J 2/17523; B41J 2/1752; B41J 2/17556; B41J 2/17559; B41J 2/17596; B41J 2/14233; B41J 2/14274; B41J 2002/14467
See application file for complete search history.

(56) References Cited

U.S. PATENT DOCUMENTS

2007/0252860 A1* 11/2007 Nitta ..... B41J 2/175 347/14
2009/0027435 A1* 1/2009 Katada ..... B41J 2/17556 347/14
2009/0244131 A1* 10/2009 Shibata ..... B41J 2/17556 347/9
2010/0245495 A1* 9/2010 Katada ..... B41J 2/175 347/85
2015/0183227 A1* 7/2015 Ishikawa ..... B41J 2/175 347/89

* cited by examiner

*Primary Examiner* — Anh T Vo
(74) *Attorney, Agent, or Firm* — Duft & Bornsen, PC

(57) ABSTRACT

Fluid tanks for providing a print fluid to a printhead. In one embodiment, the fluid tank includes a first reservoir configured to contain a print fluid, and a second reservoir configured to contain the print fluid. The fluid tank further includes a first Input/Output (I/O) port configured to fluidly couple with a printhead to allow the print fluid to flow into or out of the first reservoir, and a second I/O port configured to fluidly couple with the printhead to allow the print fluid to flow into or out of the second reservoir. The fluid tank further includes a flexible membrane between the first reservoir and the second reservoir configured to flex to create a pressure difference between the first reservoir and the second reservoir.

20 Claims, 15 Drawing Sheets

FLUID TANK WITH FLEXIBLE MEMBRANE FOR A FLOW-THROUGH PRINTHEAD

TECHNICAL FIELD

The following disclosure relates to the field of image formation, and in particular, to the supply of a print fluid to printheads.

BACKGROUND

Image formation is a procedure whereby a digital image is recreated on a medium by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and a diaphragm that is driven by an actuator, such as a piezoelectric actuator. A printhead also includes a drive circuit that controls when each individual jetting channel fires based on image data. To jet from a jetting channel, the drive circuit provides a jetting pulse to the actuator, which causes the actuator to deform a wall of the pressure chamber via the diaphragm. The deformation of the pressure chamber creates pressure waves within the pressure chamber that eject a droplet of print fluid (e.g., ink) out of the nozzle.

Shuttle-type printers are a class of printers having a movable shuttle or carriage assemble that reciprocates back and forth across a medium. A printhead is mounted on the carriage assembly, and jetting from the printhead is synchronized with movement of the carriage assembly to print desired images. Movement of the carriage assembly is also synchronized with a medium transfer mechanism that advances the medium through the printer.

It remains an issue for manufacturers to find effective ways to supply ink or another print fluid to printheads in jetting apparatuses, such as shuttle-type printers.

SUMMARY

Embodiments described herein include a fluid tank having reservoirs that contain a print fluid and supply the print fluid to the printhead. The printhead is a flow-through type of printhead, where a print fluid is able to flow from a supply manifold through jetting channels to a return manifold, or vice-versa. A fluid tank has a flexible membrane or a flexible side wall(s) that are configured to flex or deform, such as in response to movement of a carriage assembly. The deformation of the flexible membrane or a flexible side wall(s) creates a pressure differential between the reservoirs, and causes the print fluid to flow between the reservoirs through the printhead. This advantageously prevents the print fluid from drying or coagulating when the printhead is idle.

One embodiment comprises a fluid tank that includes a first reservoir configured to contain a print fluid, and a second reservoir configured to contain the print fluid. The fluid tank further includes a first Input/Output (I/O) port configured to fluidly couple with a printhead to allow the print fluid to flow into or out of the first reservoir, and a second I/O port configured to fluidly couple with the printhead to allow the print fluid to flow into or out of the second reservoir. The fluid tank further includes a flexible membrane between the first reservoir and the second reservoir configured to flex to create a pressure difference between the first reservoir and the second reservoir.

In another embodiment, the fluid tank further comprises a deformation member attached to the flexible membrane to cause flexing of the flexible membrane.

In another embodiment, the deformation member is an elongated member disposed through a sealed opening in the fluid tank, coplanar with the flexible membrane. A first end of the deformation member is attached to the flexible membrane, and a second end of the deformation member extends outward from the fluid tank. The deformation member is configured to pivot within the sealed opening to cause flexing of the flexible membrane.

In another embodiment, the deformation member is an elongated member disposed transversely through the flexible membrane, and is attached at a center section to the flexible membrane. The deformation member is further disposed through a first sealed opening in a side wall of the first reservoir, and a second sealed opening in a side wall of the second reservoir. The deformation member is configured to slide within the first sealed opening and the second sealed opening to cause flexing of the flexible membrane.

In another embodiment, the deformation member is an elongated member disposed transversely through the flexible membrane, and is attached at a center section to the flexible membrane. The first reservoir includes a first flexible side wall attached to the deformation member toward a first end of the deformation member, and the second reservoir includes a second flexible side wall attached to the deformation member toward a second end of the deformation member. The deformation member is configured to move transversely to cause flexing of the flexible membrane, the first flexible side wall, and the second flexible side wall.

In another embodiment, the flexible membrane includes a first flexible membrane disposed between a top wall and a bottom wall of the fluid tank, and a second flexible membrane disposed between a side wall of the first reservoir and a side wall of the second reservoir. The deformation member includes a weighted member attached at an intersection between the first flexible membrane and the second flexible membrane. The deformation member is configured to twist to cause flexing of the first flexible membrane and the second flexible membrane.

In another embodiment, the fluid tank further comprises a valve connected to the first reservoir and the second reservoir.

Another embodiment comprises an apparatus that includes a flow-through printhead mounted on a carriage assembly configured to reciprocate in a sub-scan direction in relation to a medium. The flow-through printhead has a row of jetting channels configured to jet droplets of a print fluid, a supply manifold fluidly coupled to the row of jetting channels, and a return manifold fluidly coupled to the row of jetting channels. The apparatus further includes a fluid tank comprising a first reservoir fluidly coupled to the supply manifold, a second reservoir fluidly coupled to the return manifold, and a flexible membrane between the first reservoir and the second reservoir configured to oscillate in response to movement of the carriage assembly to create a pressure difference between the first reservoir and the second reservoir.

In another embodiment, the fluid tank further comprises a deformation member attached to the flexible membrane to cause oscillation of the flexible membrane.

In another embodiment, the deformation member is an elongated member disposed through a sealed opening in the fluid tank, coplanar with the flexible membrane. A first end of the deformation member is attached to the flexible membrane, and a second end of the deformation member extends outward from the fluid tank. The deformation member is configured to pivot within the sealed opening in response to the movement of the carriage assembly to cause the oscillation of the flexible membrane.

In another embodiment, the deformation member is an elongated member disposed transversely through the flexible membrane, and is attached at a center section to the flexible membrane. The deformation member is further disposed through a first sealed opening in a side wall of the first reservoir, and a second sealed opening in a side wall of the second reservoir. The deformation member is configured to slide within the first sealed opening and the second sealed opening in response to the movement of the carriage assembly to cause the oscillation of the flexible membrane.

In another embodiment, the deformation member is an elongated member disposed transversely through the flexible membrane, and is attached at a center section to the flexible membrane. The first reservoir includes a first flexible side wall attached to the deformation member toward a first end of the deformation member, and the second reservoir includes a second flexible side wall attached to the deformation member toward a second end of the deformation member. The deformation member is configured to move transversely in response to the movement of the carriage assembly to cause the oscillation of the flexible membrane, the first flexible side wall, and the second flexible side wall.

In another embodiment, the flexible membrane includes a first flexible membrane disposed between a top wall and a bottom wall of the fluid tank, and a second flexible membrane disposed between a side wall of the first reservoir and a side wall of the second reservoir. The deformation member includes a weighted member attached at an intersection between the first flexible membrane and the second flexible membrane. The deformation member is configured to twist in response to the movement of the carriage assembly to cause the oscillation of the first flexible membrane and the second flexible membrane.

In another embodiment, the weighted member includes a first fluid passage that connects diagonal chambers of the first reservoir, and includes a second fluid passage that connects diagonal chambers of the second reservoir.

In another embodiment, the flexible membrane comprises a first flexible membrane forming a side wall of the first reservoir, and a second flexible membrane forming a side wall of the second reservoir that is spaced by a distance from the first flexible membrane. The deformation member comprises a connecting member attached at a first end to the first flexible membrane, and attached at a second end to the second flexible membrane. A pendulum member is suspended from the connecting member, and is configured to swing in response to the movement of the carriage assembly to cause the oscillation of the first flexible membrane and the second flexible membrane.

Another embodiment comprises an apparatus that includes a flow-through printhead mounted on a carriage assembly configured to reciprocate in a sub-scan direction in relation to a medium. The flow-through printhead has a row of jetting channels configured to jet droplets of a print fluid, a supply manifold fluidly coupled to the row of jetting channels, and a return manifold fluidly coupled to the row of jetting channels. The apparatus further includes a fluid tank comprising a first reservoir fluidly coupled to the supply manifold, a second reservoir fluidly coupled to the return manifold, and a rigid partition between the first reservoir and the second reservoir. The first reservoir includes a first flexible side wall, and the second reservoir includes a second flexible side wall.

In another embodiment, the apparatus further includes a first pressing member configured to apply a pressing force against the first flexible side wall when the carriage assembly is at a first end of the sub-scan direction.

In another embodiment, the apparatus further includes a second pressing member configured to apply a pressing force against the second flexible side wall when the carriage assembly is at a second end of the sub-scan direction.

In another embodiment, the fluid tank further comprises a deformation member, which is an elongated member disposed transversely through a sealed opening in the rigid partition. A first end of the deformation member is attached to the first flexible side wall, and a second end of the deformation member is attached to the second flexible side wall. The deformation member is configured to move transversely in response to the movement of the carriage assembly to deform the first flexible side wall and the second flexible side wall.

In another embodiment, the fluid tank further comprises a deformation member comprising a horizontal bar, vertical bars projecting from opposing ends of the horizontal bar, and a weight attached to the horizontal bar. A first one of the vertical bars is attached to the first flexible side wall, and a second one of the vertical bars is attached to the second flexible side wall. The deformation member is configured to swing in response to the movement of the carriage assembly to deform the first flexible side wall and the second flexible side wall.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
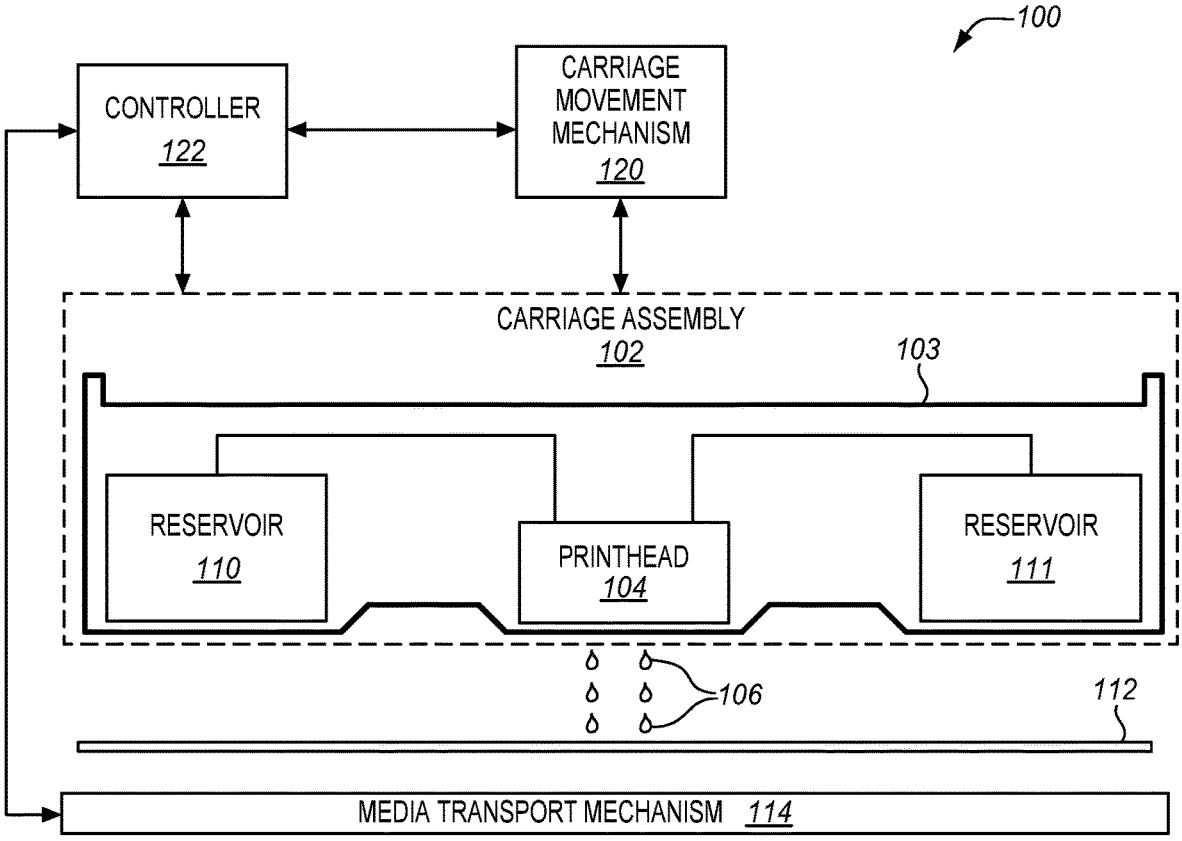
FIG. 1 is a schematic diagram of a jetting apparatus in an illustrative embodiment.

FIG. 1 is a schematic diagram of a jetting apparatus 100 in an illustrative embodiment. In this embodiment, jetting apparatus 100 is a shuttle-type apparatus that includes a carriage assembly 102. Carriage assembly 102 includes a conveyance structure 103 that reciprocates back and forth along a scan line or sub-scan direction (i.e., laterally with respect to a print media) during operation. One or more printheads 104 are mounted on conveyance structure 103. A printhead 104 is a device, apparatus, or component configured to eject droplets 106 of a print fluid, such as ink (e.g., water, solvent, oil, or UV-curable), through a plurality of orifices or nozzles (not visible in FIG. 1). The droplets 106 ejected from the nozzles of printhead 104 are directed toward medium 112. Medium 112 comprises any type of material upon which ink or another print fluid is applied by a printhead, such as paper, plastic, card stock, transparent sheets, a substrate for 3D printing, cloth, etc. Typically, nozzles of printhead 104 are arranged in one or more rows so that ejection of print fluid from the nozzles causes formation of characters, symbols, images, layers of an object, etc., on medium 112 as printhead 104 and/or medium 112 are moved relative to one another. Media transport mechanism 114 is configured to move medium 112 relative to printhead 104. Jetting apparatus 100 also includes a jetting apparatus controller 122 that controls the overall operation of jetting apparatus 100. Jetting apparatus controller 122 may connect to a data source to receive image data, and control each printhead 104 to discharge the print fluid on a desired pixel grid on medium 112. Jetting apparatus 100 also includes reservoirs 110-111 mounted on conveyance structure 103, and configured to contain a print fluid. Although not shown in FIG. 1, reservoirs 110-111 may be connected to printhead 104 via hoses or the like. Conveyance structure 103 may comprise any desired structure for mounting printhead 104 and reservoirs 110-111.

In this embodiment, carriage assembly 102 reciprocates back and forth across a surface of medium 112. To provide the movement of carriage assembly 102, jetting apparatus 100 includes a carriage movement mechanism 120 that moves carriage assembly 102 relative to medium 112 to perform print operations. For example, carriage movement mechanism 120 may include one or more elongated rods, and carriage assembly 102 may be slidably mounted to the elongated rods to move bi-directionally over the medium 112. Carriage movement mechanism 120 may also include an actuator that slides carriage assembly 102 along the elongated rods.

Figure 2:
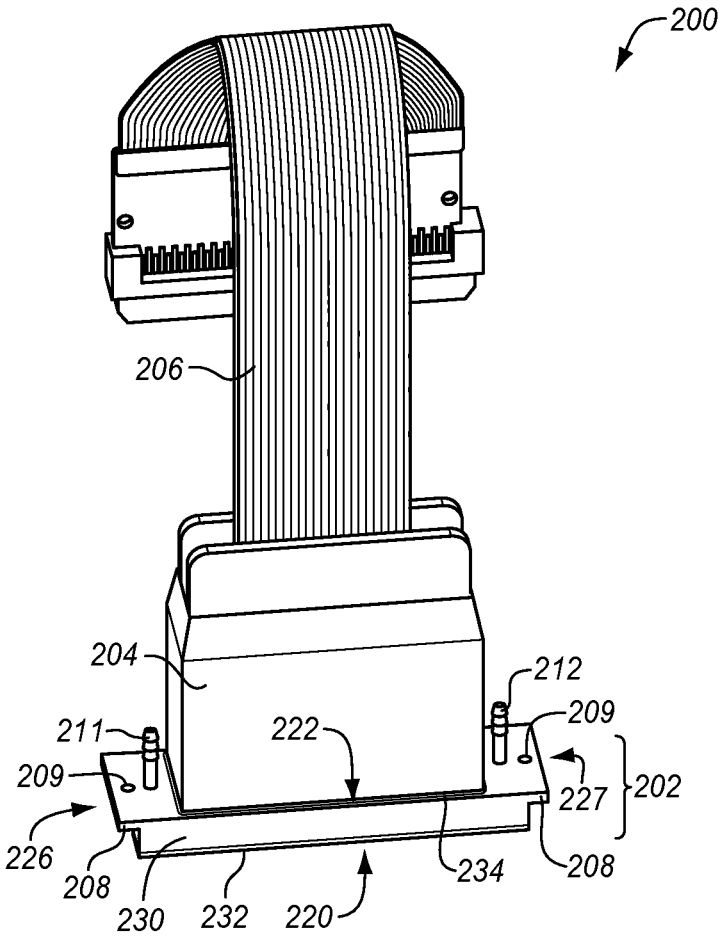
FIG. 2 is a perspective view of a printhead in an illustrative embodiment.

FIG. 2 is a perspective view of a printhead 200 in an illustrative embodiment. Printhead 200 is one example of a printhead 104 used in jetting apparatus 100. Printhead 200 includes a head member 202 and electronics 204. Head member 202 is an elongated component that forms the jetting channels of printhead 200. A typical jetting channel includes a nozzle, a pressure chamber, and a diaphragm that is driven by an actuator, such as a piezoelectric actuator. Electronics 204 control how the nozzles of printhead 200 jet droplets in response to control signals. Although not visible in FIG. 2, electronics 204 may include a plurality of actuators (e.g., piezoelectric actuators) that contact the diaphragms of the jetting channels. Electronics 204 also include cabling 206, such as a ribbon cable, that connects to a controller (e.g., jetting apparatus controller 122) to receive the control signals. Printhead 200 also includes attachment members 208, which are configured to secure printhead 200 to a jetting apparatus, such as to conveyance structure 103 as illustrated in FIG. 1. Attachment members 208 may include one or more holes 209 so that printhead 200 may be mounted within a jetting apparatus by screws, bolts, pins, etc.

The bottom surface 220 of head member 202 includes the nozzles of the jetting channels, and represents the discharge surface of printhead 200. The top surface 222 of head member 202 represents the Input/Output (I/O) portion for receiving print fluids into printhead 200 and/or conveying print fluids (e.g., fluids that are not jetted) out of printhead 200. Top surface 222, which is also referred to as the I/O surface, includes a plurality of I/O ports 211-212. Top surface 222 has two ends 226-227 that are separated by electronics 204. I/O port 211 is disposed toward end 226, and I/O port 212 is disposed toward end 227. I/O ports 211-212 may include a hose coupling, hose barb, etc., for coupling with a supply hose of a reservoir 110/111, a cartridge, or the like.

Head member 202 includes a housing 230 and a plate stack 232. Housing 230 is a rigid member made from stainless steel or another type of material. Housing 230 includes an access hole 234 that provides a passageway for electronics 204 to pass through housing 230 so that actuators may interface with diaphragms of the jetting channels. Plate stack 232 attaches to an interface surface (not visible) of housing 230. Plate stack 232 (also referred to as a laminate plate stack) is a series of plates that are fixed or bonded to one another to form a laminated stack. Plate stack 232 may include the following plates: one or more nozzle plates, one or more chamber plates, one or more restrictor plates, and a diaphragm plate. A nozzle plate includes a plurality of nozzles that are arranged in one or more rows (e.g., two rows, four rows, etc.). A chamber plate includes a plurality of openings that form the pressure chambers of the jetting channels. A restrictor plate includes a plurality of restrictors that fluidly connect the pressure chambers of the jetting channels with a manifold. A diaphragm plate is a sheet of a semi-flexible material that vibrates in response to actuation by an actuator (e.g., piezoelectric actuator).

Although a piezoelectric printhead 200 is illustrated in FIG. 2, other types of printheads 104 may be used in jetting apparatus 100, such as a thermal printhead.

Figure 3:
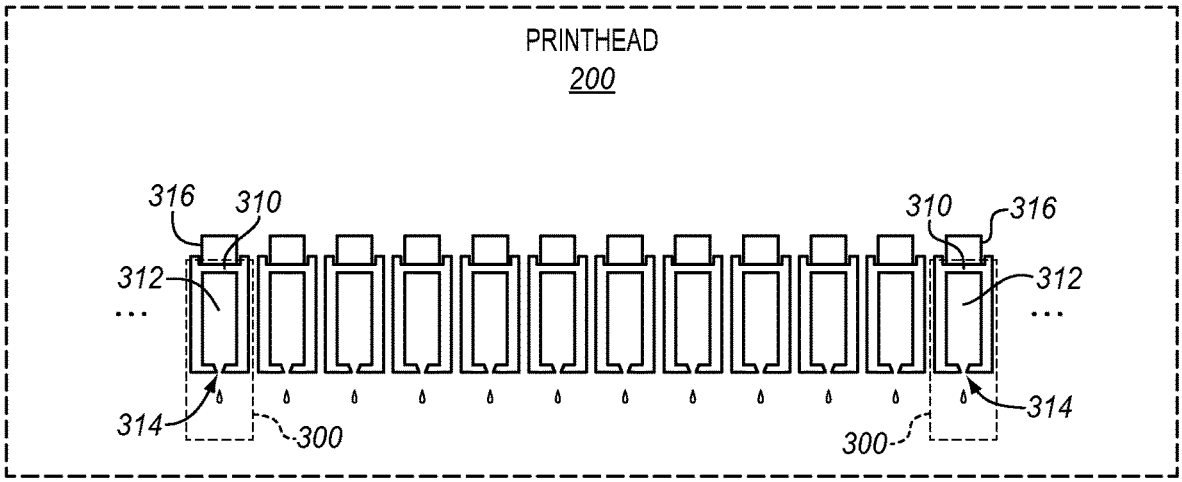
FIG. 3 is a schematic diagram of jetting channels within a printhead in an illustrative embodiment.

FIG. 3 is a schematic diagram of jetting channels 300 within printhead 200 in an illustrative embodiment. This diagram represents a view along a length of printhead 200. A jetting channel 300 is a structural element within printhead 200 that jets or ejects a print fluid. Each jetting channel 300 includes a diaphragm 310, a pressure chamber 312, and a nozzle 314. An actuator 316 contacts diaphragm 310 to control jetting from a jetting channel 300. Jetting channels 300 may be formed in one or more rows along a length of printhead 200, and each jetting channel 300 may have a similar configuration as shown in FIG. 3.

Figure 4:
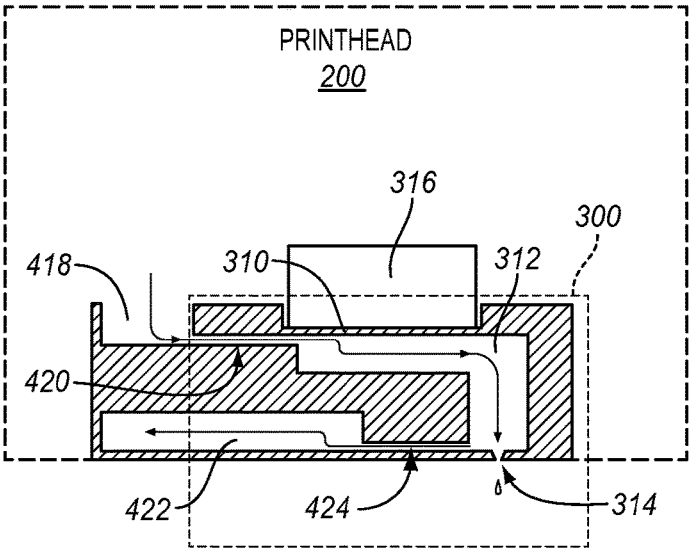
FIGS. 4-5 are schematic diagrams of a jetting channel within a printhead in an illustrative embodiment.
Figure 5:
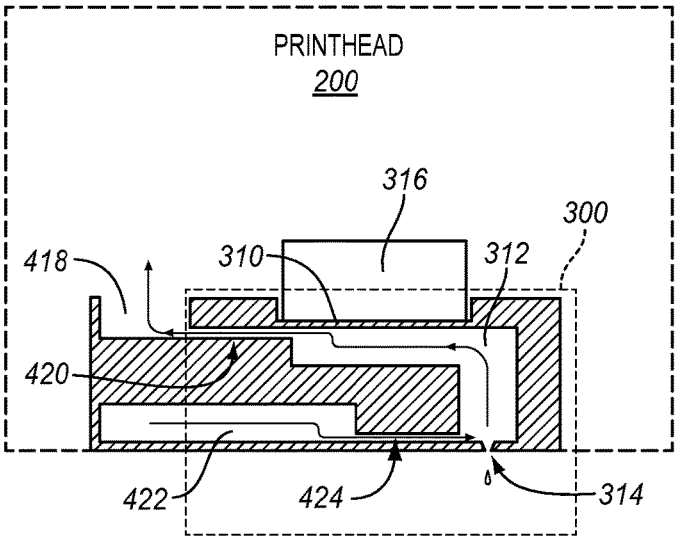

FIGS. 4-5 are schematic diagrams of a jetting channel 300 within printhead 200 in an illustrative embodiment. The view in FIGS. 4-5 is of a cross-section of a jetting channel 300 across a width of a portion of printhead 200. A supply manifold 418 is configured to supply a print fluid to jetting channel 300 through a first restrictor 420. Restrictor 420 fluidly couples pressure chamber 312 with supply manifold 418, and controls the flow of the print fluid into pressure chamber 312. A return manifold 422 is configured convey a print fluid out of a jetting channel 300 through a second restrictor 424. Restrictor 424 fluidly couples pressure chamber 312 to return manifold 422, and controls the flow of the print fluid out of pressure chamber 312. Printhead 200 is a "flow-through" printhead or re-circulating printhead, which means that the print fluid may be re-circulated through printhead 200 past each nozzle 314. By having a flow-through design, a print fluid is able to flow from supply manifold 418 to a return manifold 422 through jetting channels 300 in printhead 200.

The arrow in FIG. 4 illustrates a flow path of a print fluid through jetting channel 300 in one direction. Although not shown in FIG. 4, supply manifold 418 is coupled to reservoir 110, and return manifold 422 is coupled to reservoir 111. The print fluid flows from supply manifold 418 in printhead 200 and into pressure chamber 312 through a first restrictor 420. One wall of pressure chamber 312 is formed with diaphragm 310 that physically interfaces with actuator 316, and vibrates in response to actuation by actuator 316. The print fluid flows through pressure chamber 312 and out of nozzle 314 in the form of a droplet in response to actuation by actuator 316. Actuator 316 is configured to receive a drive waveform, and to actuate or "fire" in response to a jetting pulse on the drive waveform. Firing of actuator 316 in jetting channel 300 creates pressure waves in pressure chamber 312 that cause jetting of a droplet from nozzle 314. The print fluid, which is not jetted from nozzle 314, flows from pressure chamber 312 into return manifold 422 through a second restrictor 424. The print fluid may flow through jetting channel 300 due to a pressure difference between reservoir 110 coupled to supply manifold 418, and reservoir 111 coupled to return manifold 422.

The arrow in FIG. 5 illustrates a flow path of a print fluid within jetting channel 300 in a reverse direction. The print fluid flows from return manifold 422 and into pressure chamber 312 through the second restrictor 424. The print fluid flows through pressure chamber 312 and out of nozzle 314 in the form of a droplet in response to actuation by actuator 316. The print fluid, which is not jetted from nozzle 314, flows from pressure chamber 312 into supply manifold 418 through the first restrictor 420. The length of the first restrictor 420 may be the same as the length of the second restrictor 424 to allow for a reversal of flow in this manner.

Jetting channel 300 as shown in FIGS. 3-5 is an example to illustrate a basic structure of a jetting channel, such as the diaphragm, pressure chamber, and nozzle. Other types of jetting channels are also considered herein. For example, some jetting channels may have a pressure chamber having a different shape than is illustrated in FIGS. 3-5. Also, the position of supply manifold 418, return manifold 422, and/or restrictors 420/424 may differ in other embodiments.

Figure 6:
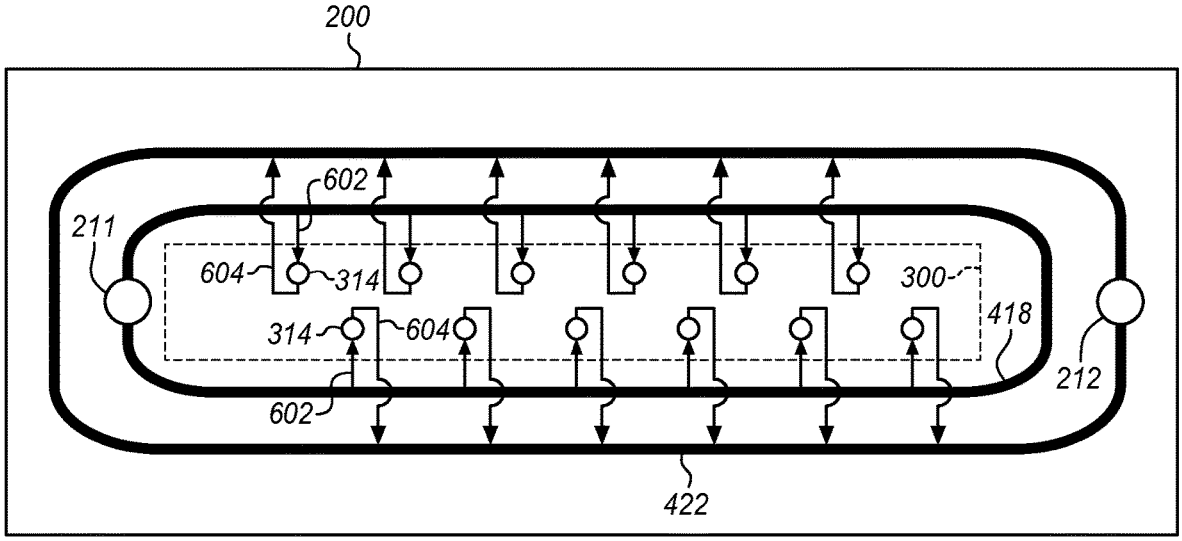
FIG. 6 is a schematic diagram of a printhead in an illustrative embodiment.

FIG. 6 is a schematic diagram of printhead 200 in an illustrative embodiment. The jetting channels 300 of printhead 200 are schematically illustrated in FIG. 6 as nozzles in two nozzle rows. Although the nozzles are shown as staggered in FIG. 6, the nozzles in the two nozzle rows may be aligned in other embodiments. Also, there may be more or less than two nozzle rows in other embodiments. Head member 202 of printhead 200 includes supply manifold 418, which is a groove, duct, conduit, etc., within head member 202 that is configured to convey or supply a print fluid to/from jetting channels 300. Supply manifold 418 is fluidly coupled to I/O port 211, and is also fluidly coupled to the jetting channels 300 indicated by nozzles 314 via fluid path 602. Fluid path 602 is provided in the form of a restrictor (e.g., restrictor 420), which is a passageway that fluidly couples a manifold to a pressure chamber and prevents a backflow of print fluid. When a print fluid is supplied to I/O port 211, the print fluid flows through supply manifold 418 and is drawn into the jetting channels 300. The major portions or sections of supply manifold 418 are disposed longitudinally within printhead 200 to fluidly couple with a row of jetting channels 300.

Head member 202 of printhead 200 also includes return manifold 422, which is a groove, duct, conduit, etc., within head member 202 that is configured to convey or receive a print fluid to/from jetting channels 300. Return manifold 422 is fluidly coupled to I/O port 212, and is also fluidly coupled to the jetting channels 300 indicated by nozzles 314 via fluid path 604. Fluid path 604 is provided in the form of a restrictor (e.g., restrictor 424). A print fluid may flow out of jetting channels 300, through return manifold 422, and out I/O port 212. The major portions or sections of return manifold 422 are disposed longitudinally within printhead 200 to fluidly couple with a row of jetting channels 300. Because the flow of print fluid through printhead 200 may be reversed, supply manifold 418 may act as a return manifold, and return manifold 422 may act as a supply manifold depending on the direction of flow of print fluid through printhead 200.

In following embodiments, fluid tanks (e.g., ink tanks) are described that provide a print fluid to a flow-through printhead or another type of printhead. One problem with a traditional jetting apparatus is that a print fluid may start to dry or coagulate in a printhead, especially when the printhead or individual jetting channels are idle. Thus, it may be beneficial to create movement of the print fluid to avoid drying. In the embodiments described below, the structure of the fluid tanks creates movement of the print fluid to prevent drying in the tank and/or printhead.

Figure 7:
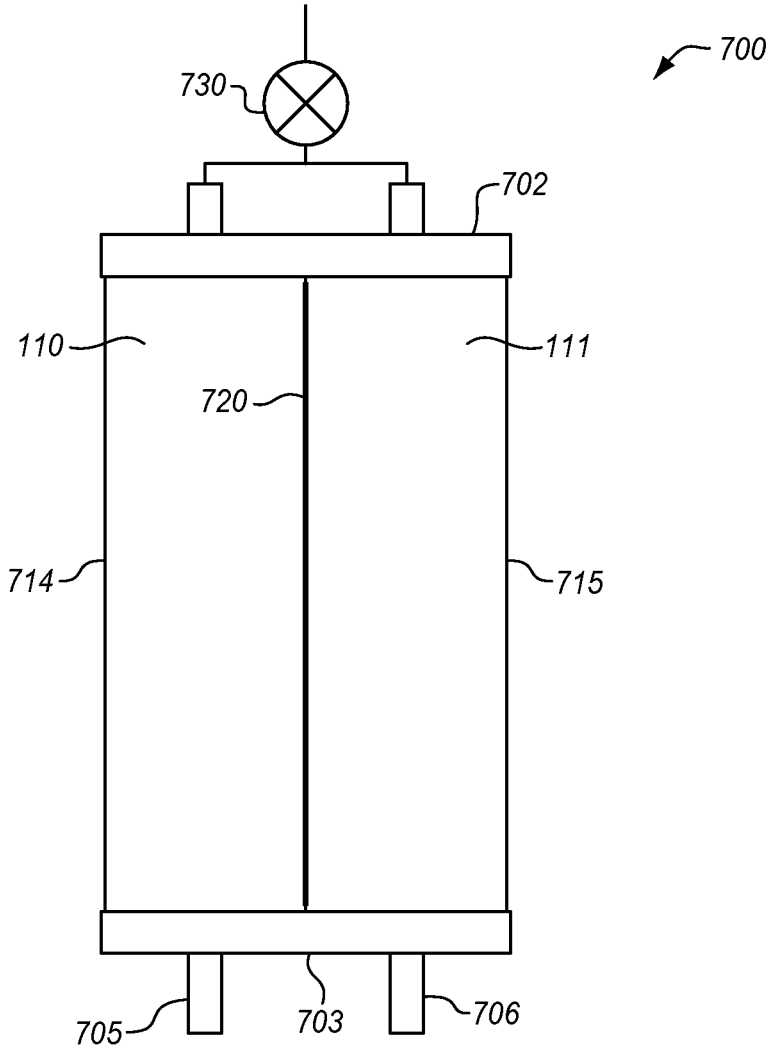
FIG. 7 illustrates a fluid tank in an illustrative embodiment.

FIG. 7 illustrates a fluid tank 700 in an illustrative embodiment. A fluid tank comprises a receptacle or storage chamber for a print fluid. FIG. 7 is a side view of fluid tank 700, and shows a top wall 702, a bottom wall 703, and side walls 714-715. Fluid tank 700 may be rectangular shaped, cylindrical shaped, or another shape so the number of side walls 714-715 depends on the shape. Top wall 702 and a bottom wall 703 may be formed from a rigid material, such as a plastic. Side walls 714-715 may be formed from a rigid material in some embodiments, and from a flexible material in other embodiments. Fluid tank 700 has two integrated reservoirs 110-111 disposed between top wall 702 and bottom wall 703 that are configured to contain a print fluid. Fluid tank 700 includes an Inlet/Outlet (I/O) port 705 configured to fluidly couple with a printhead, where a print fluid may flow into or out of reservoir 110. Fluid tank 700 also includes an I/O port 706 configured to fluidly couple with a printhead, where a print fluid may flow into or out of reservoir 111. Fluid tank 700 also includes a flexible membrane 720 or multiple flexible membranes between reservoir 110 and reservoir 111. Flexible membrane 720 is a thin pliable sheet (or sheets) of material (i.e., impermeable) that forms a barrier, wall, divider, or boundary between reservoir 110 and reservoir 111. Flexible membrane 720 may extend between top wall 702 and bottom wall 703, or may extend at least a portion of the distance between top wall 702 and bottom wall 703. Flexible membrane 720 is configured to curve, twist, bow, shift, flex, or otherwise deform, such as in response to movement of a carriage assembly, to create a pressure differential between reservoir 110 and reservoir 111. In FIG. 7, the volumes of reservoirs 110-111 are the same when flexible membrane 720 is not deformed. When flexible membrane 720 deforms, the volume of one reservoir increases and the volume of the other reservoir decreases, which creates a pressure differential. Fluid tank 700 also includes a valve 730 coupled to reservoir 110 and reservoir 111, which is configured to release pressure in one or both of reservoirs 110-111.

Figure 10:
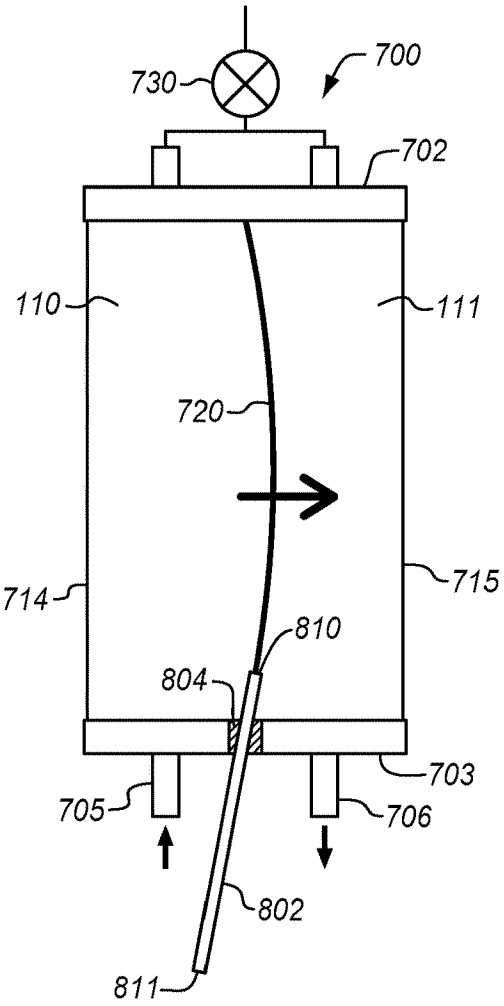
FIGS. 8-10 illustrate a fluid tank with a deformation member in an illustrative embodiment.
Figure 9:
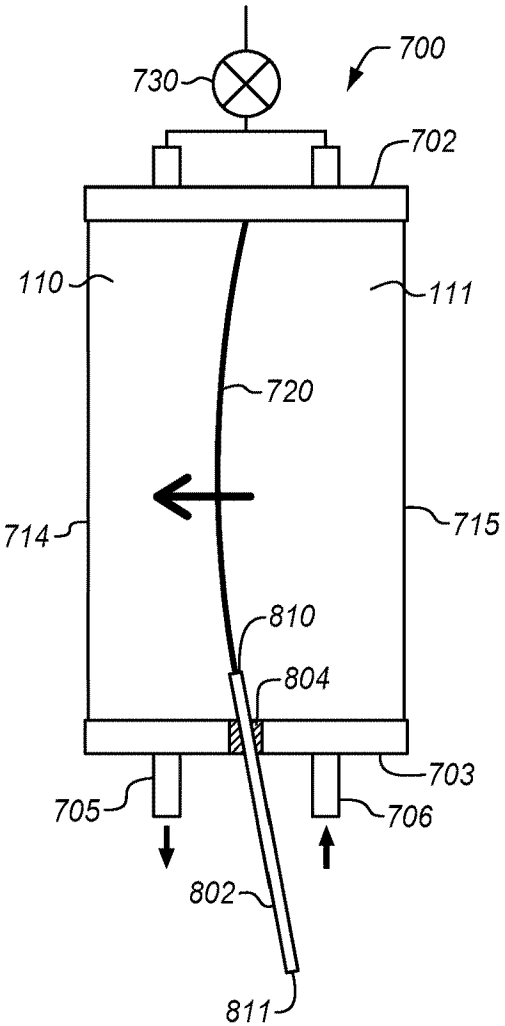
Figure 8:
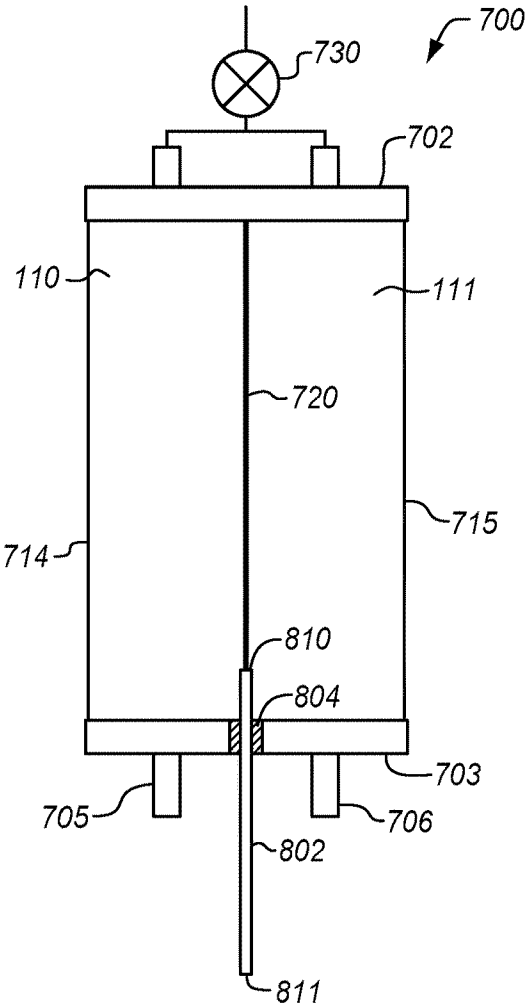

In one embodiment, the movement of print fluid in reservoirs 110-111 may be sufficient to deform flexible membrane 720. In other embodiments, a deformation member may be attached to flexible membrane 720 in some manner to deform flexible membrane 720 in a desired manner. FIGS. 8-10 illustrate fluid tank 700 with a deformation member in an illustrative embodiment. In this embodiment, deformation member 802 is an elongated member, such as a cylindrical rod or bar. Deformation member 802 is disposed through a sealed opening 804 in fluid tank 700 (i.e., in bottom wall 703), and is oriented generally coplanar with flexible membrane 720. Flexible membrane 720 generally extends between top wall 702 and bottom wall 703. One end 810 of deformation member 802 is attached to flexible membrane 720, and the other end 811 of deformation member 802 extends outward from fluid tank 700 and is unrestrained. Deformation member 802 is configured to pivot within sealed opening 804, such as in response to movement of a carriage assembly. Sealed opening 804 defines a pivot point for deformation member 802. A back-and-forth pivoting motion of deformation member 802 creates a corresponding back-and-forth motion, flexing, or oscillation of flexible membrane 720. FIGS. 9-10 illustrate oscillation of flexible membrane 720 in response to a back-and-forth pivoting motion of deformation member 802. In FIG. 9, end 811 of deformation member 802 shifts to the right, which shifts flexible membrane 720 to the left. In FIG. 10, end 811 of deformation member 802 shifts to the left, which shifts flexible membrane 720 to the right. This movement or pivoting of deformation member 802 creates an oscillation of flexible membrane 720 in response to the reciprocation of carriage assembly 102 along the sub-scan direction. Although a printhead 104 is not shown in FIGS. 9-10, when flexible membrane 720 shifts to the left as in FIG. 9, the volume of reservoir 110 decreases and the volume of reservoir 111 increases. This causes the print fluid to flow out of reservoir 110 and into reservoir 111 (through a printhead 104), as indicated by the arrows. When flexible membrane 720 shifts to the right as in FIG. 10, the volume of reservoir 110 increases and the volume of reservoir 111 decreases. This causes the print fluid to flow out of reservoir 111 and into reservoir 110 (through a printhead 104), as indicated by the arrows.

Figure 11:
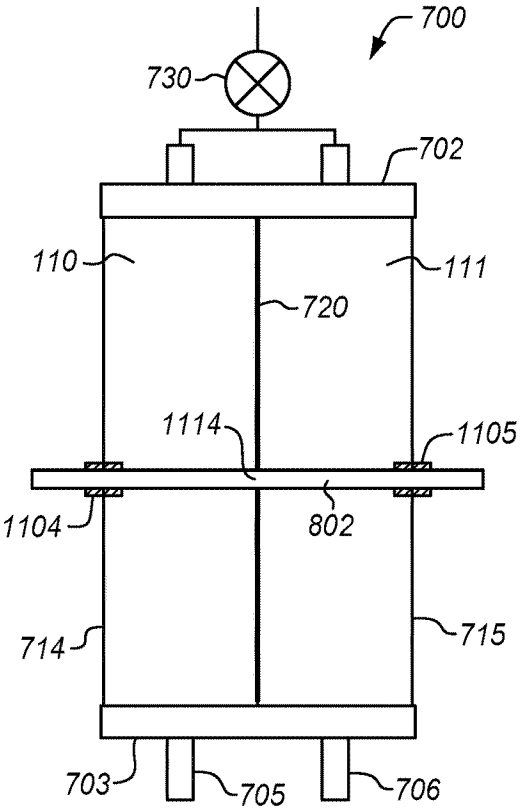
FIGS. 11-13 illustrate a fluid tank with a deformation member in another illustrative embodiment.
Figure 12:
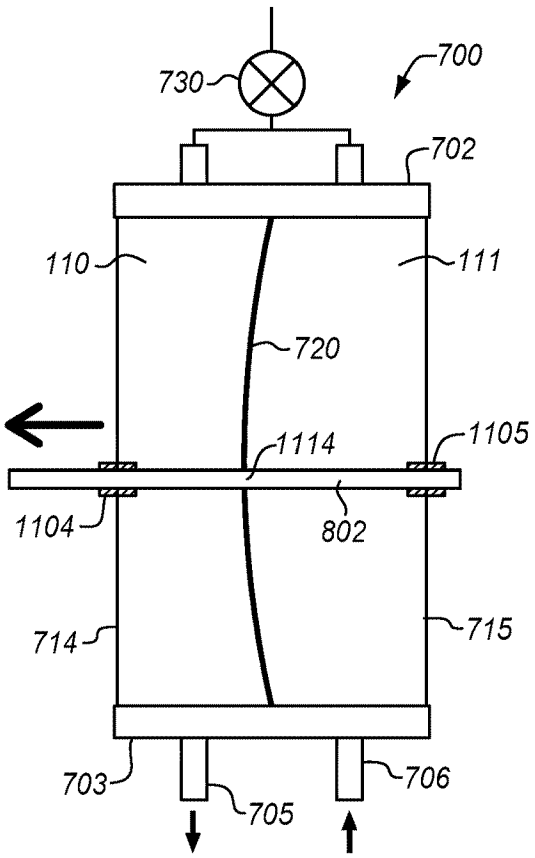
Figure 13:
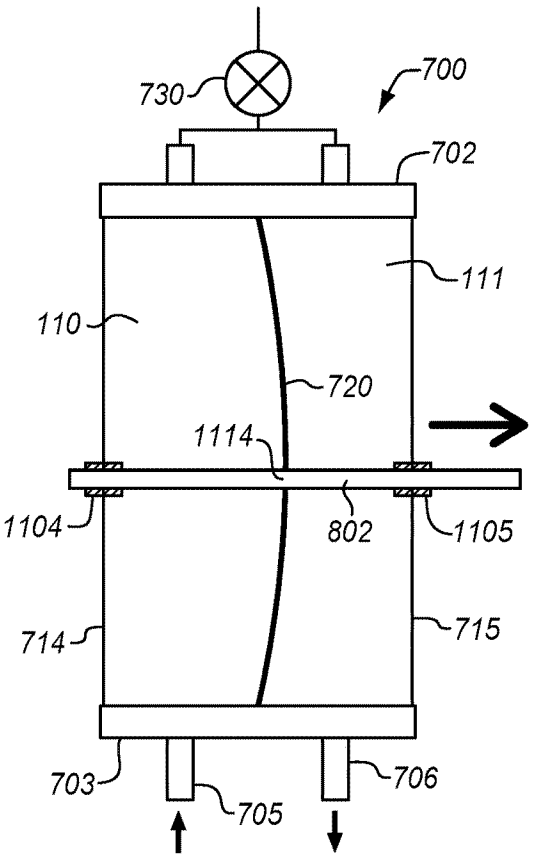

FIGS. 11-13 illustrate fluid tank 700 with a deformation member in another illustrative embodiment. In this embodiment, deformation member 802 is again an elongated member, such as a cylindrical rod or bar. Deformation member 802 is oriented generally transverse to flexible membrane 720, which extends between top wall 702 and bottom wall 703. Deformation member 802 is disposed through flexible membrane 720, and is attached at a center section 1114 in a sealed manner to flexible membrane 720. Deformation member 802 is further disposed through a sealed opening 1104 in side wall 714 (rigid) of reservoir 110, and through a sealed opening 1105 in side wall 715 (rigid) of reservoir 111. Deformation member 802 is configured to slide within sealed openings 1104-1105, such as in response to movement of a carriage assembly. A back-and-forth sliding motion of deformation member 802 creates a corresponding back-and-forth motion or oscillation of flexible membrane 720. FIGS. 12-13 illustrate oscillation of flexible membrane 720 in response to a back-and-forth sliding motion of deformation member 802. In FIG. 12, deformation member 802 shifts to the left, which shifts flexible membrane 720 to the left. In FIG. 13, deformation member 802 shifts to the right, which shifts flexible membrane 720 to the right. This movement or sliding of deformation member 802 creates an oscillation of flexible membrane 720 in response to the reciprocation of carriage assembly 102 along the sub-scan direction.

Figure 16:
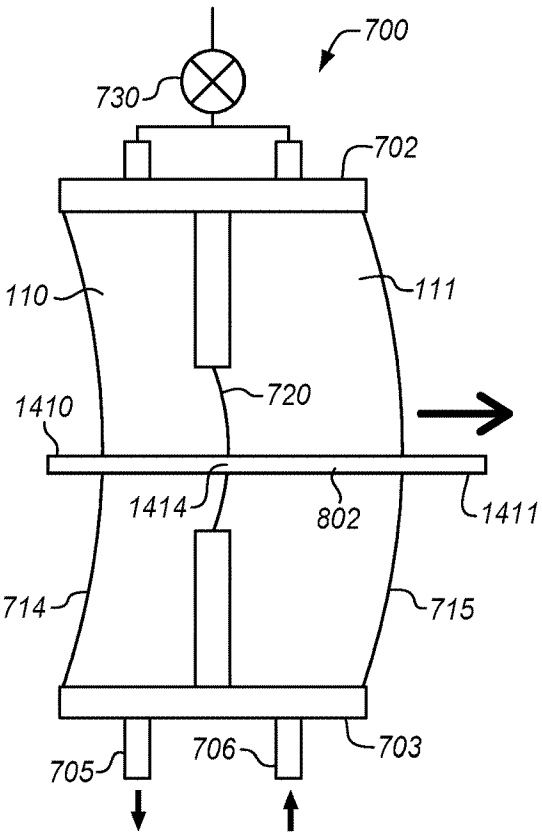
FIGS. 14-16 illustrate a fluid tank with a deformation member in another illustrative embodiment.
Figure 15:
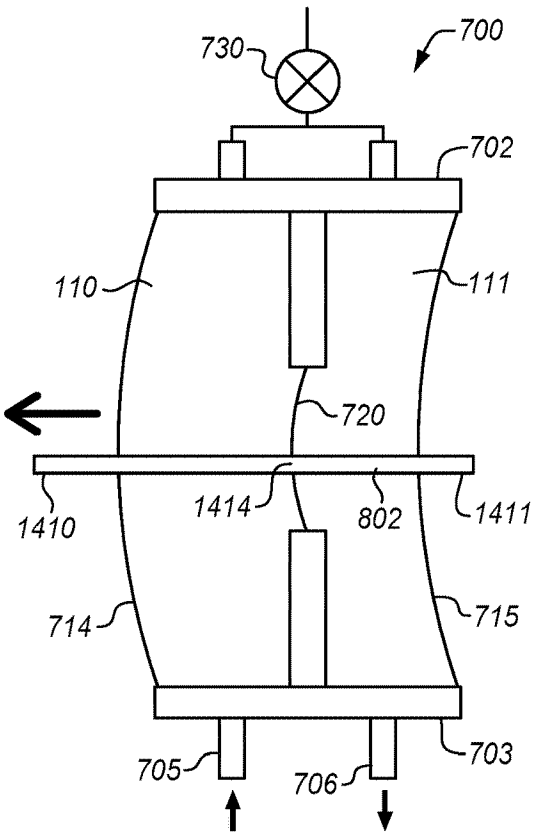
Figure 14:
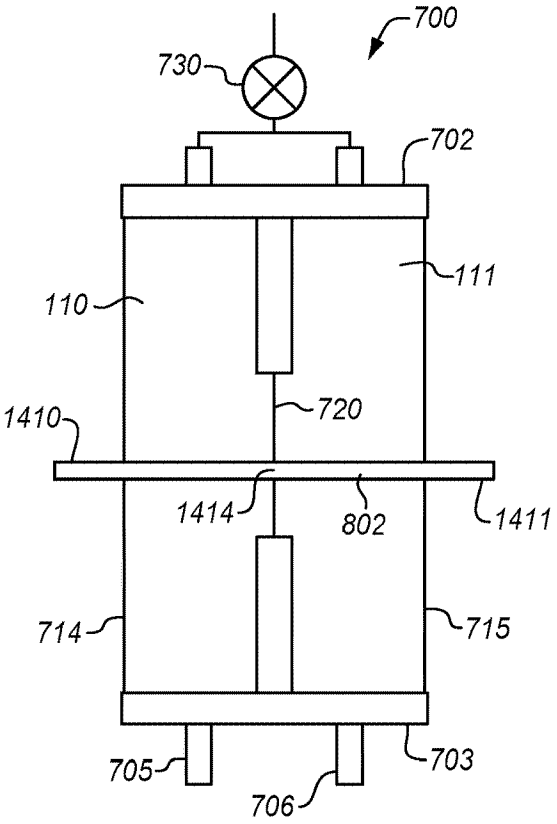

FIGS. 14-16 illustrate fluid tank 700 with a deformation member in another illustrative embodiment. In this embodiment, deformation member 802 is again an elongated member, such as a cylindrical rod or bar. Deformation member 802 is oriented generally transverse to flexible membrane 720, which extends partially between top wall 702 and bottom wall 703. Deformation member 802 is disposed through flexible membrane 720, and is attached at a center section 1414 to flexible membrane 720. In this embodiment, side walls 714-715 are made from a flexible material. Deformation member 802 is disposed through side wall 714 of reservoir 110, and is attached in a sealed manner to side wall 714 toward end 1410. Deformation member 802 is further disposed through side wall 715 of reservoir 111, and is attached in a sealed manner to side wall 715 toward end 1411. Deformation member 802 is configured to move, shift, or translate transversely, such as in response to movement of a carriage assembly. A back-and-forth motion of deformation member 802 creates a corresponding back-and-forth motion or oscillation of flexible membrane 720 and side walls 714-715. FIGS. 15-16 illustrate oscillation of flexible membrane 720 and side walls 714-715 in response to a back-and-forth motion of deformation member 802. In FIG. 15, deformation member 802 shifts to the left, which shifts flexible membrane 720 and side walls 714-715 to the left. In FIG. 16, deformation member 802 shifts to the right, which shifts flexible membrane 720 and side walls 714-715 to the right. This movement of deformation member 802 creates an oscillation of flexible membrane 720 and side walls 714-715 in response to the reciprocation of carriage assembly 102 along the sub-scan direction.

Figure 17:
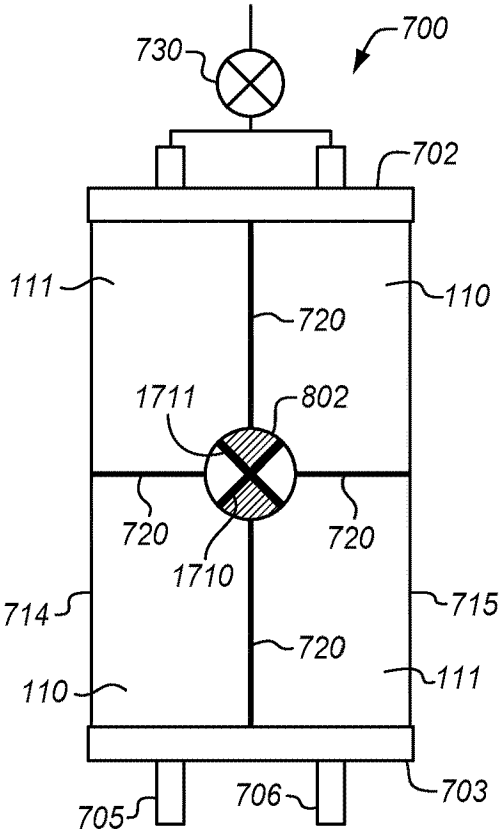
FIGS. 17-19 illustrate a fluid tank with a deformation member in another illustrative embodiment.
Figure 18:
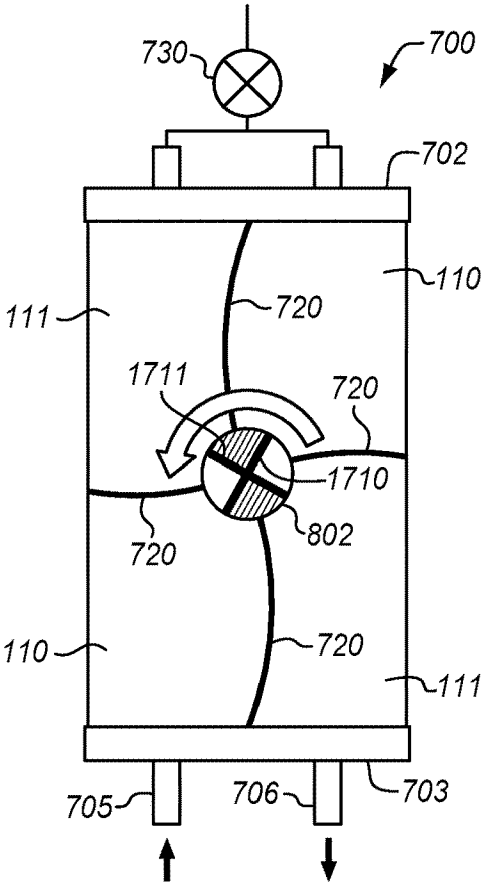
Figure 19:
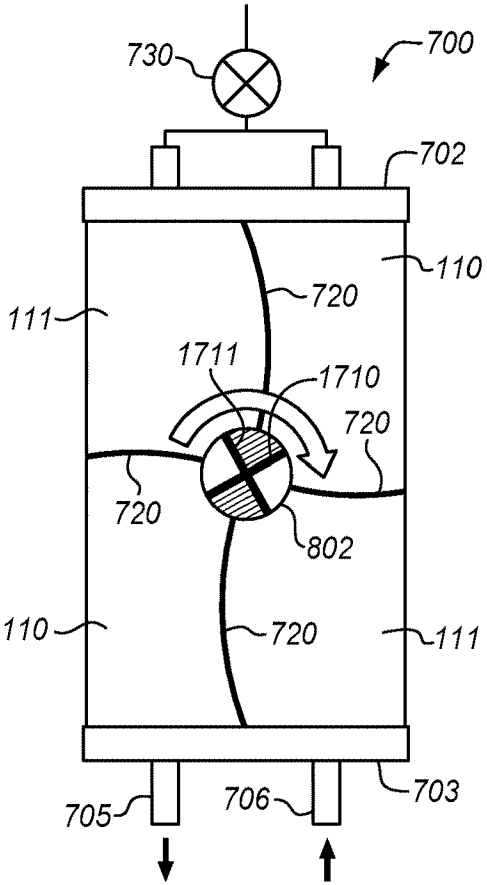

FIGS. 17-19 illustrate fluid tank 700 with a deformation member in another illustrative embodiment. In this embodiment, deformation member 802 is a weighted member disposed within fluid tank 700, such as a ball, a spherical mass, or a mass of another desired shape. In this embodiment, side walls 714-715 may be rigid. A flexible membrane 720 generally extends between top wall 702 and bottom wall 703, and another flexible membrane 720 generally extends between side walls 714-715. Thus, reservoir 110 is separated into diagonal chambers by flexible membranes 720, and reservoir 111 is also separated into diagonal chambers by flexible membranes 720. Deformation member 802 is attached in a sealed manner to flexible membranes 720 toward the middle of flexible membranes 720 or at the intersection between flexible membranes 720. Deformation member 802 includes a fluid passage 1710 configured to fluidly couple the diagonal chambers of reservoir 110, and includes a fluid passage 1711 configured to fluidly couple the diagonal chambers of reservoir 111. Deformation member 802 is configured to twist, turn, or rotate, such as in response to movement of a carriage assembly. A twisting motion of deformation member 802 creates a corresponding an oscillation of flexible membranes 720. FIGS. 18-19 illustrate oscillation of flexible membranes 720 in response to a twisting motion of deformation member 802. In FIG. 18, deformation member 802 twists toward the left, which deforms flexible membranes 720 and causes the print fluid to flow out of reservoir 111 and into reservoir 110 (through a printhead 104), as indicated by the arrows. In FIG. 19, deformation member 802 twists to the right, which deforms flexible membranes 720 and causes the print fluid to flow out of reservoir 110 and into reservoir 111 (through a printhead 104), as indicated by the arrows. This movement of deformation member 802 creates an oscillation of flexible membranes 720 in response to the reciprocation of carriage assembly 102 along the sub-scan direction.

Figure 22:
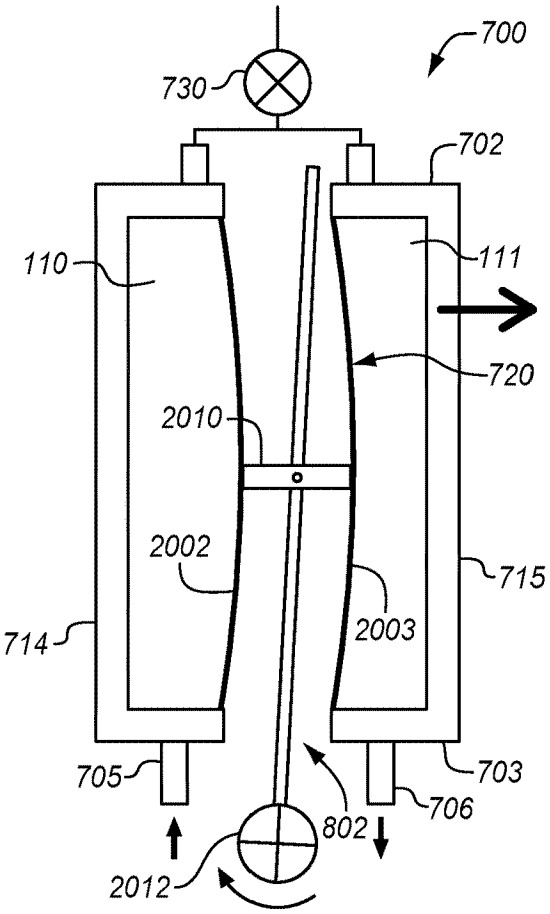
FIGS. 20-22 illustrate a fluid tank with a deformation member in another illustrative embodiment.
Figure 21:
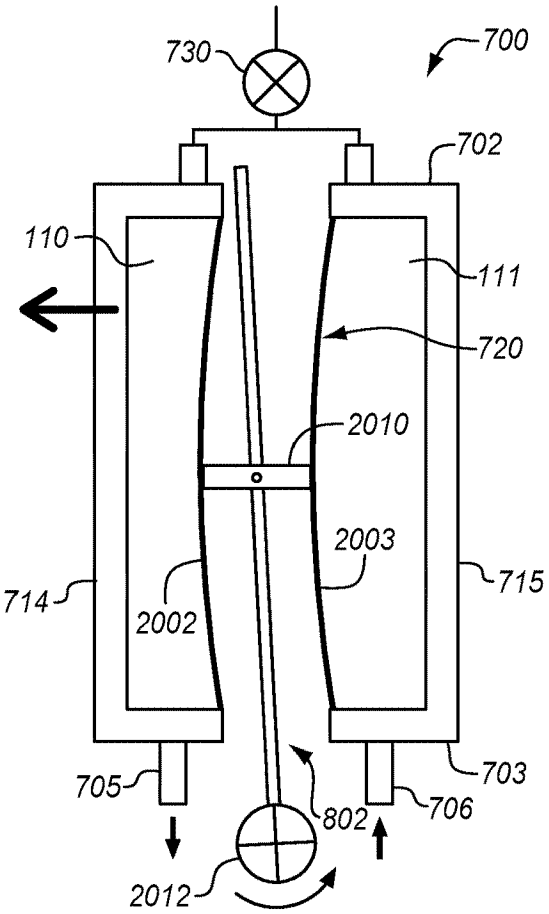
Figure 20:
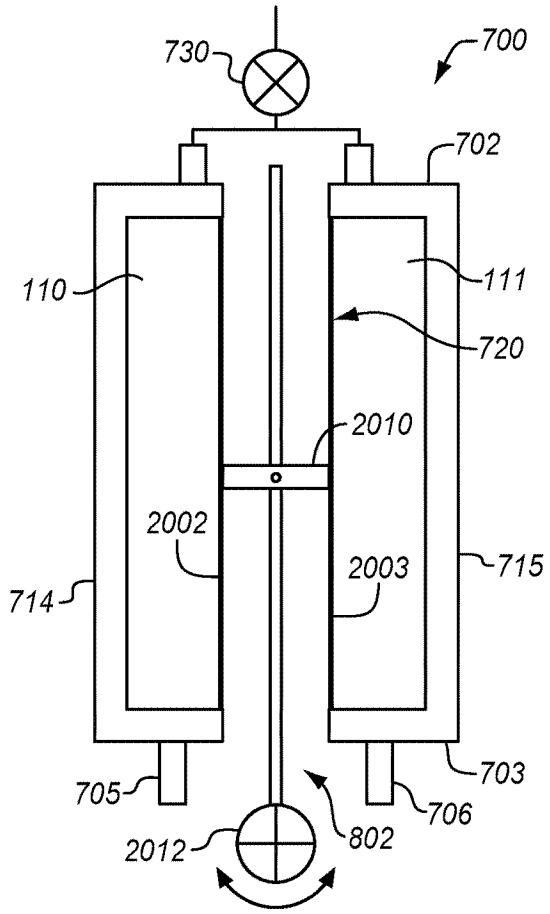

FIGS. 20-22 illustrate fluid tank 700 with a deformation member in another illustrative embodiment. In this embodiment, flexible membrane 720 between reservoirs 110-111 is comprised of a first flexible membrane 2002 forming a side wall of reservoir 110, and a second flexible membrane 2003 forming a side wall of reservoir 111. Flexible membranes 2002-2003 are spaced by a distance. Deformation member 802 includes a connecting member 2010 that is attached at one end to flexible membrane 2002 and is attached at the other end to flexible membrane 2003. Deformation member 802 also includes a pendulum member 2012 suspended from connecting member 2010. Pendulum member 2012 is configured to swing, such as in response to movement of a carriage assembly. A back-and-forth swinging motion of pendulum member 2012 creates a corresponding back-and-forth motion or oscillation of flexible membranes 2002-2003. FIGS. 21-22 illustrate oscillation of flexible membranes 2002-2003 in response to a back-and-forth swinging motion of pendulum member 2012. In FIG. 21, pendulum member 2012 swings to the right, which shifts flexible membranes 2002-2003 to the left. In FIG. 22, pendulum member 2012 swings to the left, which shifts flexible membranes 2002-2003 to the right. This movement or swinging of pendulum member 2012 creates an oscillation of flexible membranes 2002-2003 in response to the reciprocation of carriage assembly 102 along the sub-scan direction.

Figure 23:
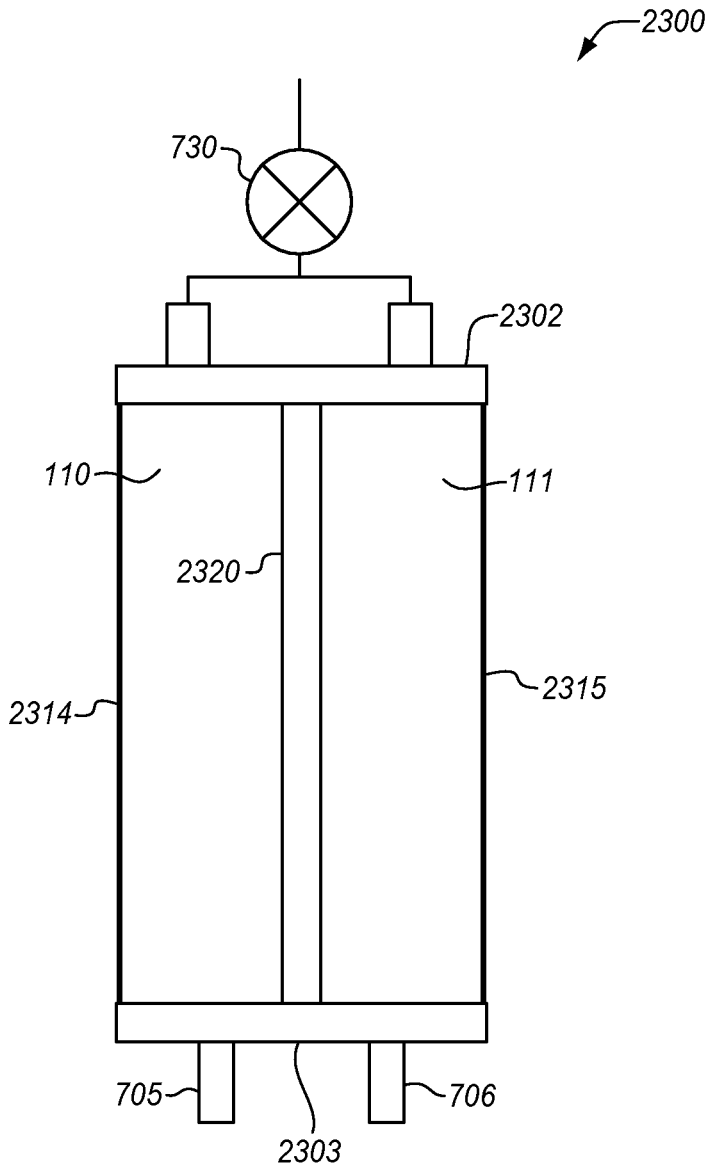
FIG. 23 illustrates a fluid tank in another illustrative embodiment.

FIG. 23 illustrates a fluid tank 2300 in another illustrative embodiment. FIG. 23 is a side view of fluid tank 2300, and shows a top wall 2302, a bottom wall 2303, and side walls 2314-2315. Fluid tank 2300 may be rectangular shaped, cylindrical shaped, or another shape, so the number of side walls 2314-2315 depends on the shape. Top wall 2302 and a bottom wall 2303 are formed from a rigid material, and side walls 2314-2315 (at least two) are formed from a flexible material and are referred to as flexible side walls. Fluid tank 2300 has two integrated reservoirs 110-111 disposed between top wall 2302 and bottom wall 2303 that are configured to contain a print fluid. Fluid tank 2300 includes an I/O port 705 configured to fluidly couple with a printhead, where a print fluid may flow into or out of reservoir 110. Fluid tank 2300 also includes an I/O port 706 configured to fluidly couple with a printhead, where a print fluid may flow into or out of reservoir 111. Fluid tank 2300 also includes a partition 2320 between reservoir 110 and reservoir 111 that is formed from a rigid material. Flexible side walls 2314-2315 are on opposing sides of partition 2320. Flexible side walls 2314-2315 are configured to curve, twist, bow, shift, or otherwise deform in response to movement of a carriage assembly or an external application of a pressing force to create a pressure differential between reservoir 110 and reservoir 111. In FIG. 23, the volumes of reservoirs 110-111 are the same when the flexible side walls 2314-2315 are not deformed. When one or both of flexible side walls 2314-2315 deform, the volume of one or both of the reservoirs change, which creates a pressure differential. Fluid tank 2300 also includes a valve 730 coupled to reservoir 110 and reservoir 111, which is configured to release pressure in one or both of reservoirs 110-111.

Figure 24:
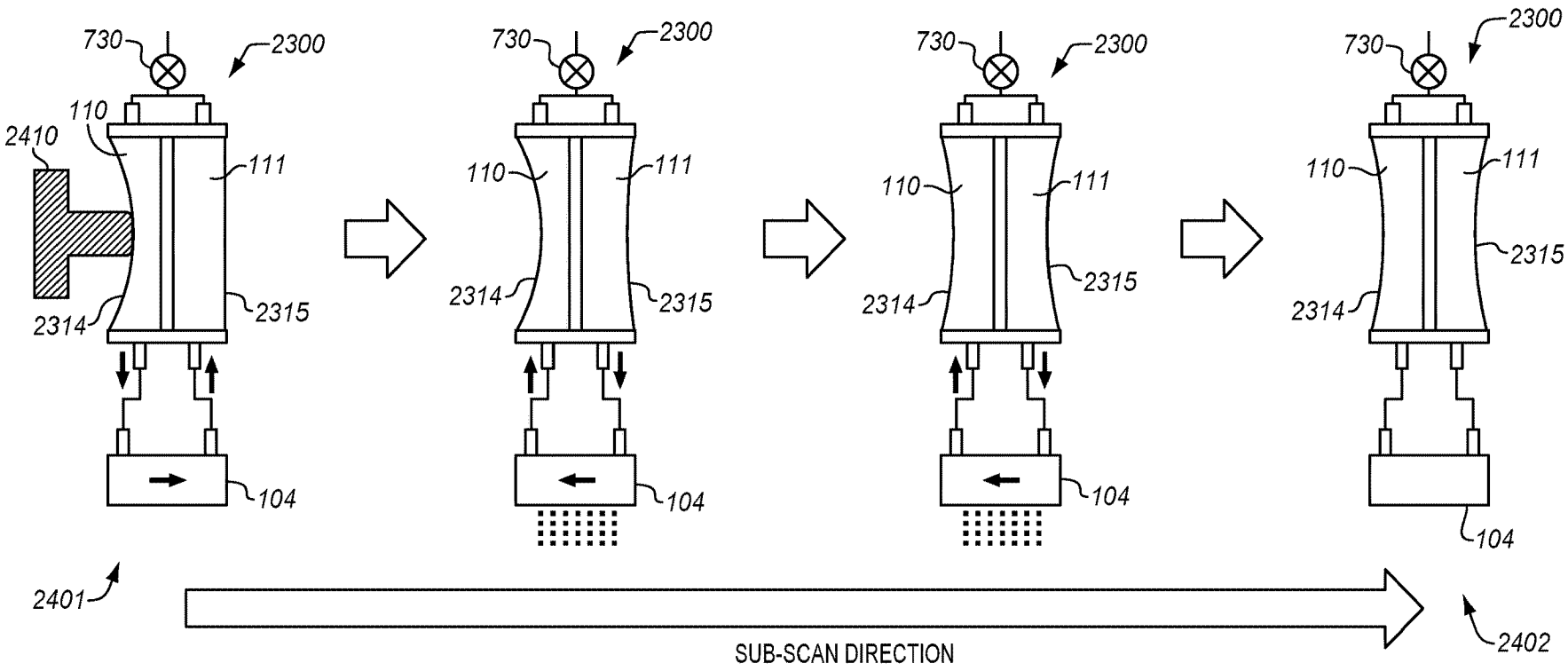
FIG. 24 illustrates a scan of a printhead and a fluid tank in an illustrative embodiment.

FIG. 24 illustrates a scan of printhead 104 and fluid tank 2300 in an illustrative embodiment. As stated above, carriage assembly 102 is configured to reciprocate along a sub-scan direction. FIG. 24 shows printhead 104 and fluid tank 2300 at a first end 2401 (to the left in FIG. 24) of the sub-scan direction. At the first end 2401 of the sub-scan direction, a pressing member 2410 is disposed in jetting apparatus 100 so that it applies a pressing force against flexible side wall 2314. Pressing member 2410 may comprise any structural element that applies a desired pressing force. For example, a rounded post may be installed in jetting apparatus 100 at or near the first end 2401 of the sub-scan direction. When printhead 104 and fluid tank 2300 move toward the first end 2401 of the sub-scan direction, flexible side wall 2314 of fluid tank 2300 is brought into contact with the rounded post. Thus, the rounded post applies a pressing force against flexible side wall 2314 based on its positioning in jetting apparatus 100 in relation to the travel of fluid tank 2300. The deformation of flexible side wall 2314 causes the volume of reservoir 110 to decrease, and the print fluid to flow out of reservoir 110 and into reservoir 111 (through printhead 104), as indicated by the arrows. As printhead 104 moves along the sub-scan direction (left to right), fluid tank 2300 supplies the print fluid to printhead 104.

When fluid tank 2300 is positioned at the first end 2401 of the sub-scan direction, valve 730 may be closed if it is an active valve. Valve 730 may remain closed as printhead 104 and fluid tank 2300 move along the sub-scan direction toward the second end 2402. When at the second end 2402, valve 730 may be opened if it is an active valve. Alternatively, if valve 730 is a one-way valve, then it may open whenever the negative pressure exceeds a threshold.

Figure 25:
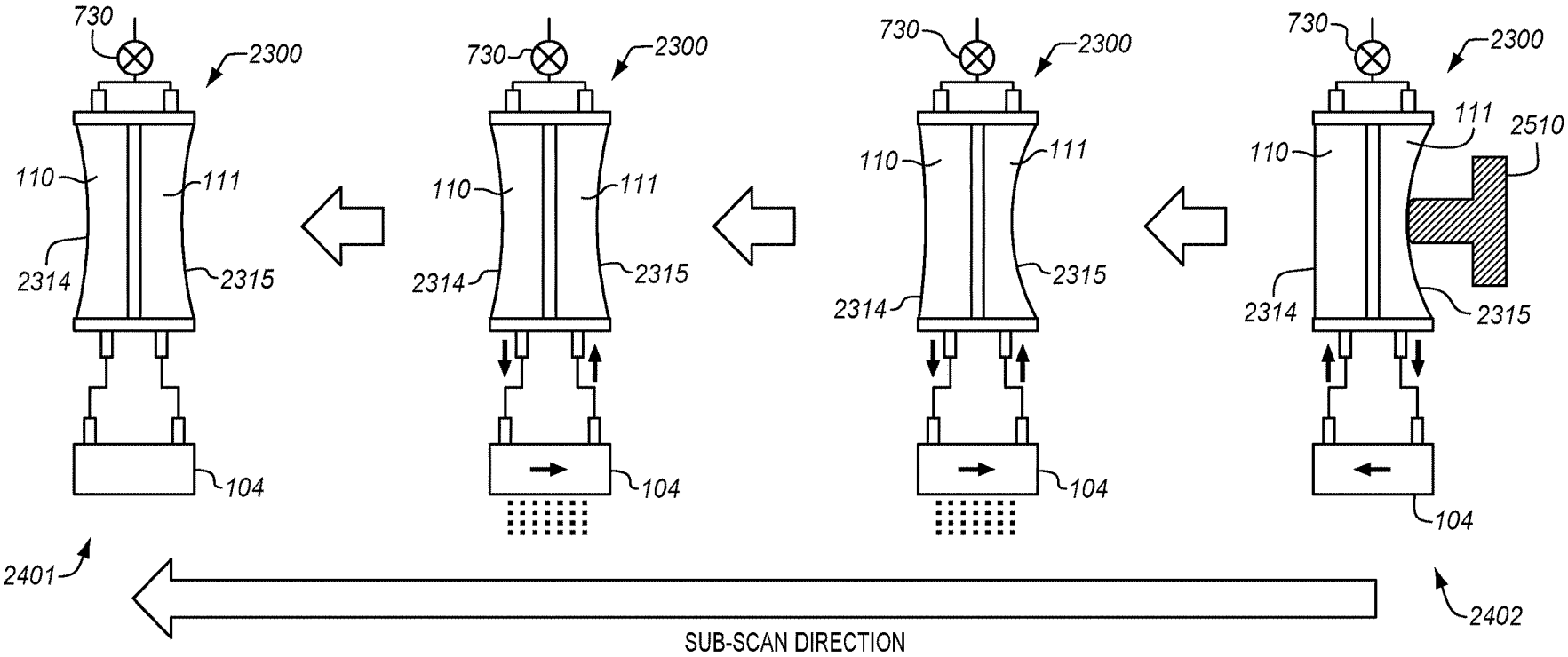
FIG. 25 illustrates a scan of a printhead and fluid tank in another illustrative embodiment.

FIG. 25 illustrates a scan of printhead 104 and fluid tank 2300 in another illustrative embodiment. FIG. 25 shows printhead 104 and fluid tank 2300 at the second end 2402 (to the right in FIG. 25) of the sub-scan direction. At the second end 2402 of the sub-scan direction, a pressing member 2510 is disposed in jetting apparatus 100 so that it applies a pressing force against flexible side wall 2315. Like pressing member 2410, pressing member 2510 may comprise any structural element that applies a desired pressing force. For example, a rounded post may be installed in jetting apparatus 100 at or near the second end 2402 of the sub-scan direction. When printhead 104 and fluid tank 2300 move toward the second end 2402 of the sub-scan direction, flexible side wall 2315 of fluid tank 2300 is brought into contact with the rounded post. Thus, the rounded post applies a pressing force against flexible side wall 2315 based on its positioning in jetting apparatus 100 in relation to the travel of fluid tank 2300. The deformation of flexible side wall 2315 causes the volume of reservoir 111 to decrease, and the print fluid to flow out of reservoir 111 and into reservoir 110 (through printhead 104), as indicated by the arrows. As printhead 104 moves along the sub-scan direction (right to left), fluid tank 2300 supplies the print fluid to printhead 104.

Figure 28:
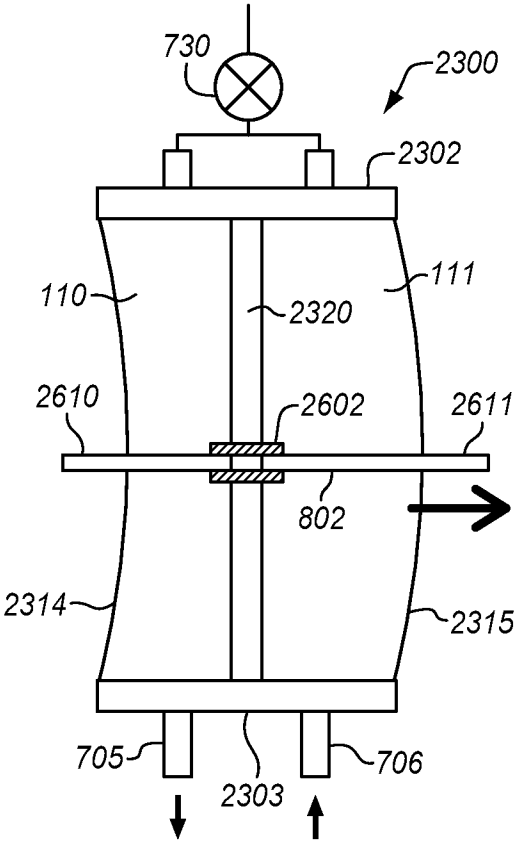
FIGS. 26-28 illustrate a fluid tank with a deformation member in another illustrative embodiment.
Figure 27:
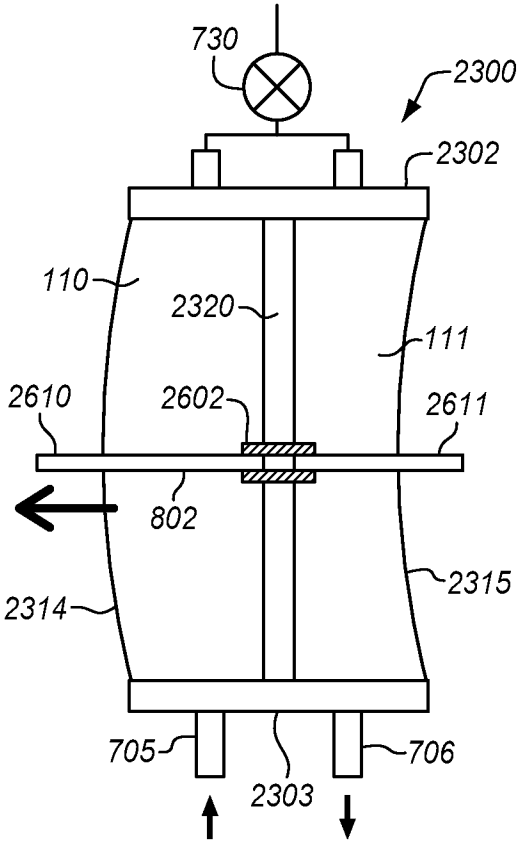
Figure 26:
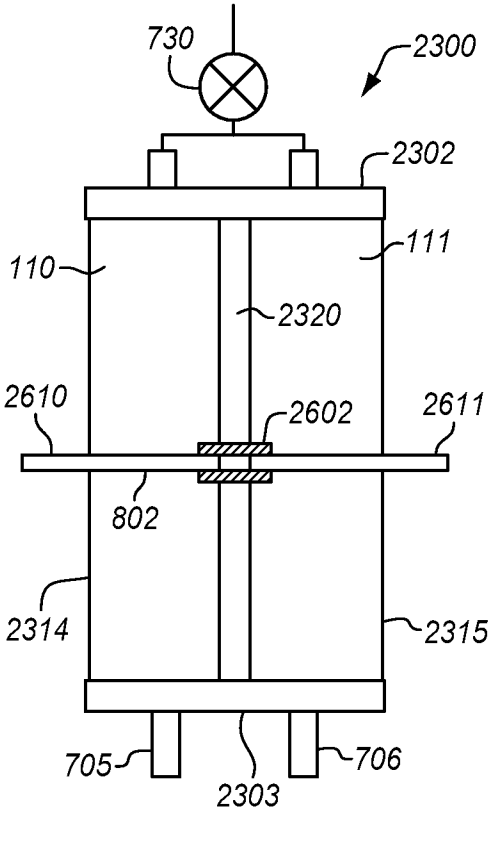

In other embodiments, a deformation member may be attached to flexible walls 2314-2315 to deform flexible walls 2314-2315 in a desired manner. FIGS. 26-28 illustrate fluid tank 2300 with a deformation member in another illustrative embodiment. In this embodiment, deformation member 802 is an elongated member, such as a cylindrical rod or bar. Deformation member 802 is oriented generally transverse to partition 2320 and flexible walls 2314-2315. Deformation member 802 is disposed through a sealed opening 2602 in partition 2320. Deformation member 802 is disposed through side wall 2314 of reservoir 110, and is attached in a sealed manner to side wall 2314 toward end 2610. Deformation member 802 is further disposed through side wall 2315 of reservoir 111, and is attached in a sealed manner to side wall 2315 toward end 2611. Deformation member 802 is configured to move, shift, or translate transversely, such as in response to movement of a carriage assembly. A back-and-forth motion of deformation member 802 creates a corresponding back-and-forth motion or oscillation of flexible walls 2314-2315. FIGS. 27-28 illustrate oscillation of flexible walls 2314-2315 in response to a back-and-forth motion of deformation member 802. In FIG. 27, deformation member 802 shifts to the left, which shifts flexible walls 2314-2315 to the left. In FIG. 28, deformation member 802 shifts to the right, which shifts flexible walls 2314-2315 to the right. This movement of deformation member 802 creates an oscillation of flexible walls 2314-2315 in response to the reciprocation of carriage assembly 102 along the sub-scan direction.

Figure 29:
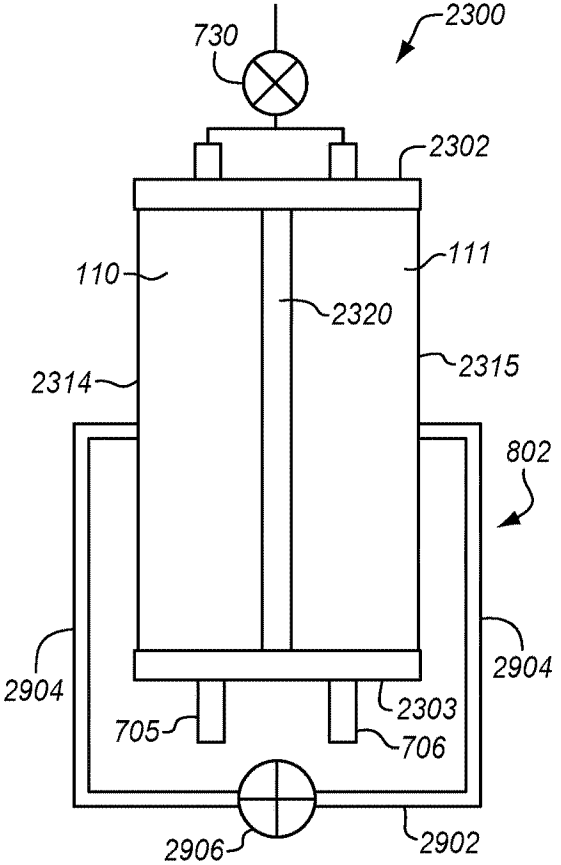
FIGS. 29-31 illustrate a fluid tank with a deformation member in another illustrative embodiment.
Figure 30:
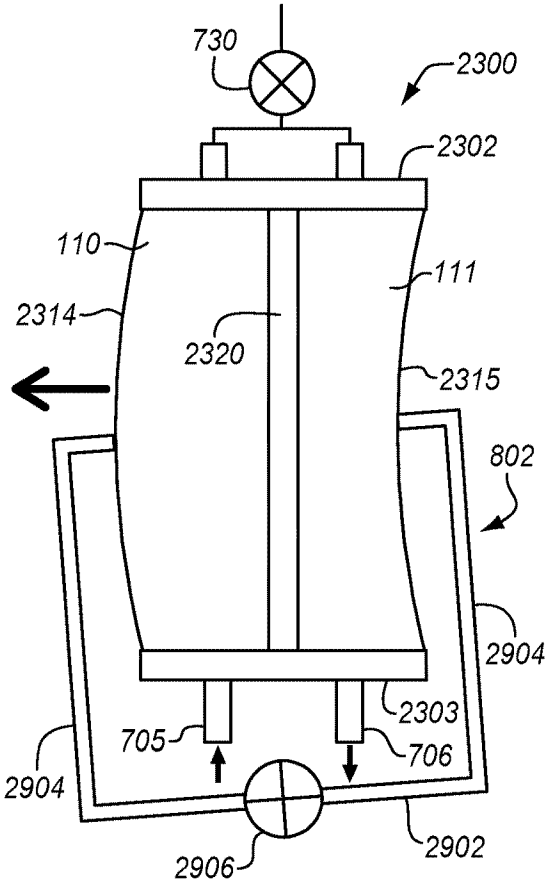
Figure 31:
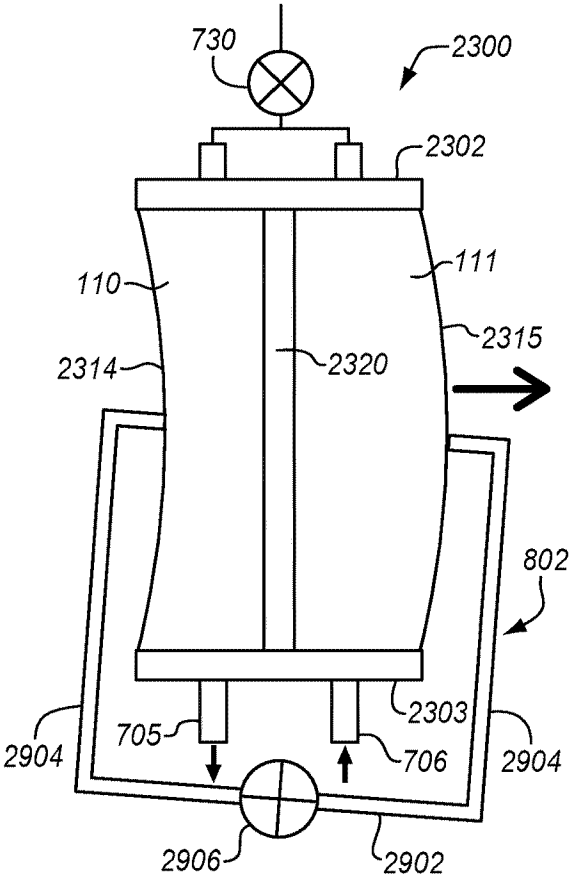

FIGS. 29-31 illustrate fluid tank 2300 with a deformation member in another illustrative embodiment. In this embodiment, deformation member 802 includes a horizontal bar 2902, and vertical bars 2904 projecting from opposing ends of horizontal bar 2902 to form a U-shape. One of the vertical bars 2904 is attached to flexible wall 2314, and the other vertical bar 2904 is attached to flexible wall 2315. Deformation member 802 further includes a weight 2906 attached to horizontal bar 2902. Deformation member 802 is configured to swing, such as in response to movement of a carriage assembly. A swinging motion of deformation member 802 creates a corresponding back-and-forth motion or oscillation of flexible walls 2314-2315. FIGS. 30-31 illustrate oscillation of flexible walls 2314-2315 in response to a swinging motion of deformation member 802. In FIG. 30, deformation member 802 swings to the right, which shifts flexible walls 2314-2315 to the left. In FIG. 31, deformation member 802 swings to the left, which shifts flexible walls 2314-2315 to the right. This movement of deformation member 802 creates an oscillation of flexible walls 2314-2315 in response to the reciprocation of carriage assembly 102 along the sub-scan direction.

Although specific embodiments were described herein, the scope of the invention is not limited to those specific embodiments. The scope of the invention is defined by the following claims and any equivalents thereof

What is claimed is:

1. A fluid tank comprising:

a first reservoir configured to contain a print fluid;

a second reservoir configured to contain the print fluid;

a first Input/Output (I/O) port configured to fluidly couple with a printhead to allow the print fluid to flow into or out of the first reservoir;

a second I/O port configured to fluidly couple with the printhead to allow the print fluid to flow into or out of the second reservoir; and a flexible membrane between the first reservoir and the second reservoir configured to flex to create a pressure difference between the first reservoir and the second reservoir.

2. The fluid tank of claim 1 further comprising:

a deformation member attached to the flexible membrane to cause flexing of the flexible membrane.

3. The fluid tank of claim 2 wherein:

the deformation member is an elongated member disposed through a sealed opening in the fluid tank, coplanar with the flexible membrane;

a first end of the deformation member is attached to the flexible membrane, and a second end of the deformation member extends outward from the fluid tank; and the deformation member is configured to pivot within the sealed opening to cause flexing of the flexible membrane.

4. The fluid tank of claim 2 wherein:

the deformation member is an elongated member disposed transversely through the flexible membrane, and is attached at a center section to the flexible membrane;

the deformation member is further disposed through a first sealed opening in a side wall of the first reservoir, and a second sealed opening in a side wall of the second reservoir; and the deformation member is configured to slide within the first sealed opening and the second sealed opening to cause flexing of the flexible membrane.

5. The fluid tank of claim 2 wherein:

the deformation member is an elongated member disposed transversely through the flexible membrane, and is attached at a center section to the flexible membrane;

the first reservoir includes a first flexible side wall attached to the deformation member toward a first end of the deformation member;

the second reservoir includes a second flexible side wall attached to the deformation member toward a second end of the deformation member; and the deformation member is configured to move transversely to cause flexing of the flexible membrane, the first flexible side wall, and the second flexible side wall.

6. The fluid tank of claim 2 wherein:

the flexible membrane includes a first flexible membrane disposed between a top wall and a bottom wall of the fluid tank, and a second flexible membrane disposed between a side wall of the first reservoir and a side wall of the second reservoir;

the deformation member includes a weighted member attached at an intersection between the first flexible membrane and the second flexible membrane; and the deformation member is configured to twist to cause flexing of the first flexible membrane and the second flexible membrane.

7. The fluid tank of claim 1 further comprising:

a valve connected to the first reservoir and the second reservoir.

8. An apparatus comprising:

a flow-through printhead mounted on a carriage assembly configured to reciprocate in a sub-scan direction in relation to a medium;

wherein the flow-through printhead has a row of jetting channels configured to jet droplets of a print fluid, a supply manifold fluidly coupled to the row of jetting channels, and a return manifold fluidly coupled to the row of jetting channels; and a fluid tank comprising:

a first reservoir fluidly coupled to the supply manifold;

a second reservoir fluidly coupled to the return manifold; and a flexible membrane between the first reservoir and the second reservoir configured to oscillate in response to movement of the carriage assembly to create a pressure difference between the first reservoir and the second reservoir.

9. The apparatus of claim 8 wherein the fluid tank further comprises:

a deformation member attached to the flexible membrane to cause oscillation of the flexible membrane.

10. The apparatus of claim 9 wherein:

the deformation member is an elongated member disposed through a sealed opening in the fluid tank, coplanar with the flexible membrane;

a first end of the deformation member is attached to the flexible membrane, and a second end of the deformation member extends outward from the fluid tank; and the deformation member is configured to pivot within the sealed opening in response to the movement of the carriage assembly to cause the oscillation of the flexible membrane.

11. The apparatus of claim 9 wherein:

the deformation member is an elongated member disposed transversely through the flexible membrane, and is attached at a center section to the flexible membrane;

the deformation member is further disposed through a first sealed opening in a side wall of the first reservoir, and a second sealed opening in a side wall of the second reservoir; and the deformation member is configured to slide within the first sealed opening and the second sealed opening in response to the movement of the carriage assembly to cause the oscillation of the flexible membrane.

12. The apparatus of claim 9 wherein:

the deformation member is an elongated member disposed transversely through the flexible membrane, and is attached at a center section to the flexible membrane;

the first reservoir includes a first flexible side wall attached to the deformation member toward a first end of the deformation member;

the second reservoir includes a second flexible side wall attached to the deformation member toward a second end of the deformation member; and the deformation member is configured to move transversely in response to the movement of the carriage assembly to cause the oscillation of the flexible membrane, the first flexible side wall, and the second flexible side wall.

13. The apparatus of claim 9 wherein:

the flexible membrane includes a first flexible membrane disposed between a top wall and a bottom wall of the fluid tank, and a second flexible membrane disposed between a side wall of the first reservoir and a side wall of the second reservoir;

the deformation member includes a weighted member attached at an intersection between the first flexible membrane and the second flexible membrane; and the deformation member is configured to twist in response to the movement of the carriage assembly to cause the oscillation of the first flexible membrane and the second flexible membrane.

14. The apparatus of claim 13 wherein:

the weighted member includes a first fluid passage that connects diagonal chambers of the first reservoir, and includes a second fluid passage that connects diagonal chambers of the second reservoir.

15. The apparatus of claim 9 wherein:

the flexible membrane comprises a first flexible membrane forming a side wall of the first reservoir, and a second flexible membrane forming a side wall of the second reservoir that is spaced by a distance from the first flexible membrane; and the deformation member comprises:

a connecting member attached at a first end to the first flexible membrane, and attached at a second end to the second flexible membrane; and a pendulum member suspended from the connecting member, and configured to swing in response to the movement of the carriage assembly to cause the oscillation of the first flexible membrane and the second flexible membrane.

16. An apparatus comprising:

a flow-through printhead mounted on a carriage assembly configured to reciprocate in a sub-scan direction in relation to a medium;

wherein the flow-through printhead has a row of jetting channels configured to jet droplets of a print fluid, a supply manifold fluidly coupled to the row of jetting channels, and a return manifold fluidly coupled to the row of jetting channels; and a fluid tank comprising:

a first reservoir fluidly coupled to the supply manifold;

a second reservoir fluidly coupled to the return manifold; and a rigid partition between the first reservoir and the second reservoir;

wherein the first reservoir includes a first flexible side wall, and the second reservoir includes a second flexible side wall.

17. The apparatus of claim 16 further comprising:

a first pressing member configured to apply a pressing force against the first flexible side wall when the carriage assembly is at a first end of the sub-scan direction.

18. The apparatus of claim 17 further comprising:

a second pressing member configured to apply a pressing force against the second flexible side wall when the carriage assembly is at a second end of the sub-scan direction.

19. The apparatus of claim 16 wherein the fluid tank further comprises:

a deformation member, which is an elongated member disposed transversely through a sealed opening in the rigid partition;

wherein a first end of the deformation member is attached to the first flexible side wall;

wherein a second end of the deformation member is attached to the second flexible side wall;

wherein the deformation member is configured to move transversely in response to the movement of the carriage assembly to deform the first flexible side wall and the second flexible side wall.

20. The apparatus of claim 16 wherein the fluid tank further comprises:

a deformation member comprising:

a horizontal bar, and vertical bars projecting from opposing ends of the horizontal bar; and a weight attached to the horizontal bar;

wherein a first one of the vertical bars is attached to the first flexible side wall, and a second one of the vertical bars is attached to the second flexible side wall;

wherein the deformation member is configured to swing in response to the movement of the carriage assembly to deform the first flexible side wall and the second flexible side wall.

* * * * *